United States Patent [19]

Kimizuka et al.

[11] Patent Number: 4,676,499

[45] Date of Patent: Jun. 30, 1987

[54] SHEET SORTER

[75] Inventors: Junichi Kimizuka, Yokohama; Masaaki Ishii, Kawasaki, both of Japan

[73] Assignee: Canon Kabushiki Kaisha, Tokyo, Japan

[21] Appl. No.: 608,271

[22] Filed: May 7, 1984

[30] Foreign Application Priority Data

Aug. 13, 1980 [JP] Japan ..... 60-111464
Sep. 20, 1980 [JP] Japan ..... 60-131242

[51] Int. Cl.[4] ..... B65H 29/60; B65H 39/02

[52] U.S. Cl. ..... 271/270; 271/208; 271/258; 271/289

[58] Field of Search ..... 271/287-290, 271/296, 297, 258, 259, 273, 274, 270, 202, 305, 292; 209/534

[56] References Cited

U.S. PATENT DOCUMENTS 4,200,278 4/1980 Gindri ..... 271/186

*Primary Examiner*—Johnny D. Cherry
*Assistant Examiner*—Donald T. Hajec
*Attorney, Agent, or Firm*—Fitzpatrick, Cella, Harper & Scinto

[57] ABSTRACT

There is disclosed a sorter provided with transporter for transporting sheet members supplied with a first speed at a larger second speed along a transport path and plural bins arranged along the transport path for storing the sheet members transported by the transporter, wherein said second speed is so selected that, when a sheet member is stored in one of the bins, the succeeding sheet member does not arrive at the most upstream bin in the transport path.

8 Claims, 18 Drawing Figures

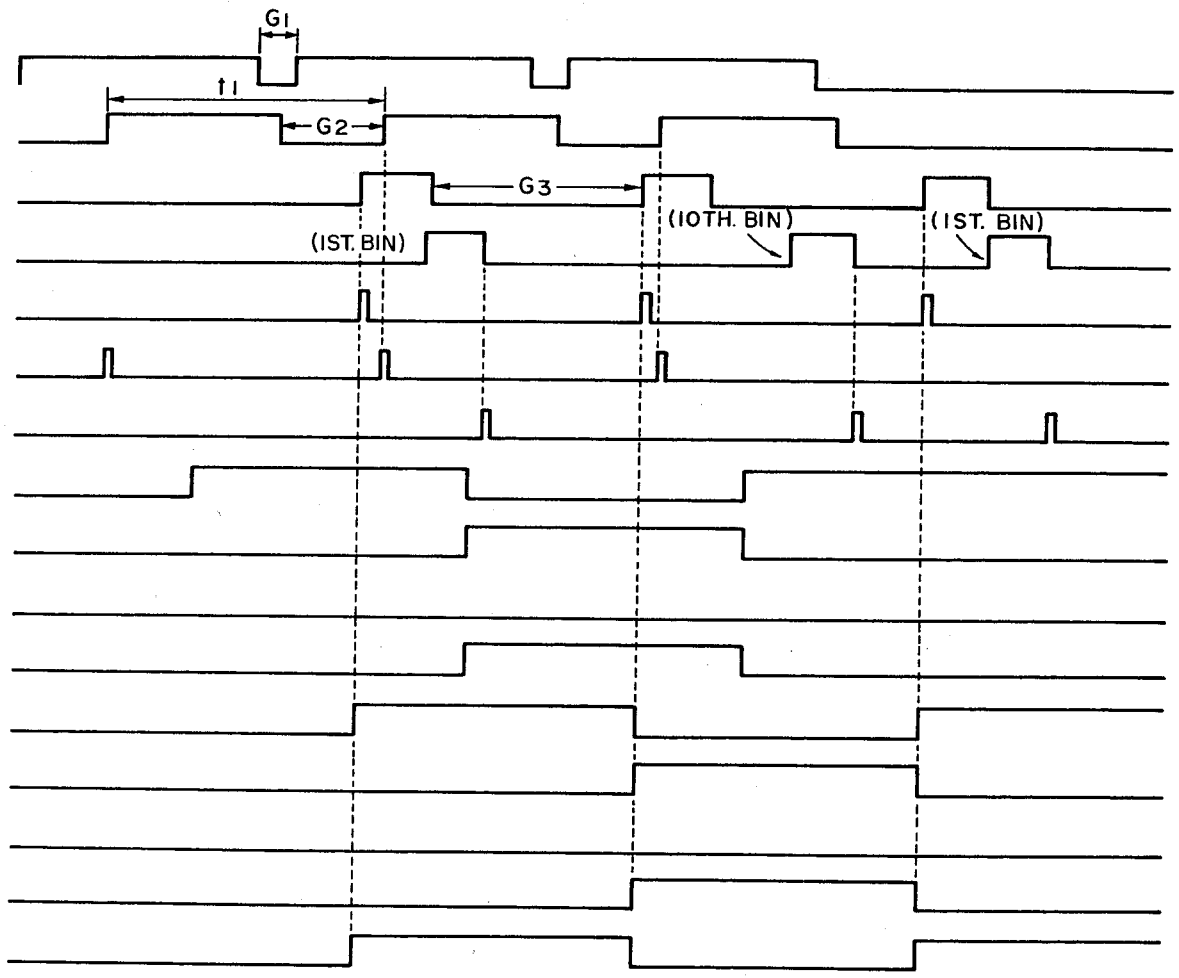

FIG. 5 a FIXING ROLLER PASS
b SW. 19 OUTPUT
c DETECTOR 40 OUTPUT
d BIN INLET SENSOR 39 OUTPUT
e DETECTOR LEADING PULSE
f SW. 19 LEADING PULSE
g BIN INLET SENSOR TRAILING PULSE
h BIN SELECT SIGNAL A
i BIN SELECT SIGNAL B
j BIN SELECT SIGNAL C
k BIN SELECT SIGNAL D
l BIN SELECT SIGNAL A AFTER LATCH
m BIN SELECT SIGNAL B AFTER LATCH
n BIN SELECT SIGNAL C AFTER LATCH
o BIN SELECT SIGNAL D AFTER LATCH
p IST. BIN DRIVE SIGNAL

SHEET SORTER

This application is a continuation of application Ser. No. 290,671 filed Aug. 5, 1981, now abandoned.

BACKGROUND OF THE INVENTION

1. Field of the Invention

The present invention relates to a sheet sorter capable of sorting and collating in plural storage bins sheet members ejected in succession from a recording apparatus such as a laser beam printer or a copier after image formation therein, and capable of being connected in series.

2. Description of the Prior Art

In the conventional sorter or collator for sorting recording sheet members into plural storage bins to obtain identically sorted sets of sheets, it is possible to store the sheet members sequentially supplied from the copier into the first bin located at the most upstream position in the transport path, then into the second bin and down to the n-th bin in successive manner. After the completion of n copies, the original has to be replaced for the next n copies to provide an inevitably wider space between the sheet stored in the n-th bin and the sheet to be subsequently stored in the first bin, and this fact avoids the inconvenience of arrival of the sheet at the first bin before the preceding sheet is stored in the n-th bin.

Consequently such sorter can employ a successive control for the sorting sheets into the bins, with a simple control mechanism.

In case the number of bins in each softer is not sufficient there are employed plural sorters connected in series, and, if the sheets are jammed in one of such sorters, the sorting operation is interrupted only in the sorter having caused such jamming.

However, for certain recording apparatus such as high-speed copier or laser beam printer required is random access of the sheets to the storage bins.

Also in such recording apparatus the above-mentioned jam handling process does not pose problem in the sorters downstream of the jammed sorter since the sheets eventually in transport at the jamming may thereafter be sorted into the storage bins without causing errors in the collating order. However in the sorters upstream of the jammed sorter, the sheets present therein and destined to those sorters are sorted regardless of the jamming. The removal of sheets in case of such jamming is easy if they remain in the transport path in the sorters but is quite difficult once they are stored in the bins. For example in case of a recording apparatus for printing the information from a computer, such as the laser beam printer, the operator is unable to known the page currently printed, and is unable to know the bins in which the sheets are stored after the jamming because of the often random access of the sheets of the bins. Also if the sheets transported in the sorters after the jamming are not removed before the restart of printing, there will result overlapping pages in certain bins since the printing operation is restarted from the point of jamming.

SUMMARY OF THE INVENTION

The object of the present invention is to provide a sorter allowing random access to the bins with a simple structure.

More specifically the object of the present invention is to provide a sorter provided with transport means for transporting sheet members supplied with a first speed at a larger second speed along a transport path and plural bins arranged along said transport path for storing the sheet members transported by said transport means, wherein said second speed is so selected that, when a sheet member is stored in one of said bins, the succeeding sheet member does not arrive at the most upstream bin in said transport path.

Another object of the present invention is to provide a sorter allowing easy jam handling in case of the use of plural sorters connected in series.

More specifically said another object of the present invention is to provide a sorter provided with a sheet member transport unit, plural sheet member storage bins and means for distributing sheet members to said storage bins, wherein, in case of a defective sheet transport in one of such sorters connected in series, all the sheet members transported upstream of said defective sorter are collected in a determined position of said sorter.

Still another object of the present invention is to provide a sorter capable of collecting, when a defective sheet transport is detected, sheet members in an openable upper part of the transport unit in a sorter having causing said defective transport.

The foregoing and still other objects of the present invention will be made apparent from the following description.

BRIEF DESCRIPTION OF THE DRAWING

FIGS. 5 to 7 are waveform charts of various signals in the circuit shown in FIG. 4;

DESCRIPTION OF THE PREFERRED EMBODIMENTS

Now the present invention will be clarified by an embodiment thereof shown in the attached drawings.

Figure 1:
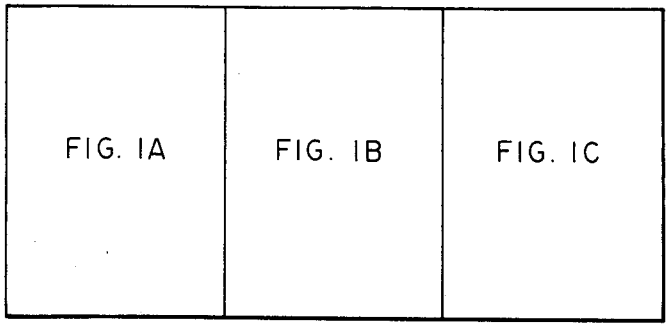
FIGS. 1A, 1B and 1C shows, in their combination, a cross-sectional viw of a sorter embodying the present invention.
Figure 1C:
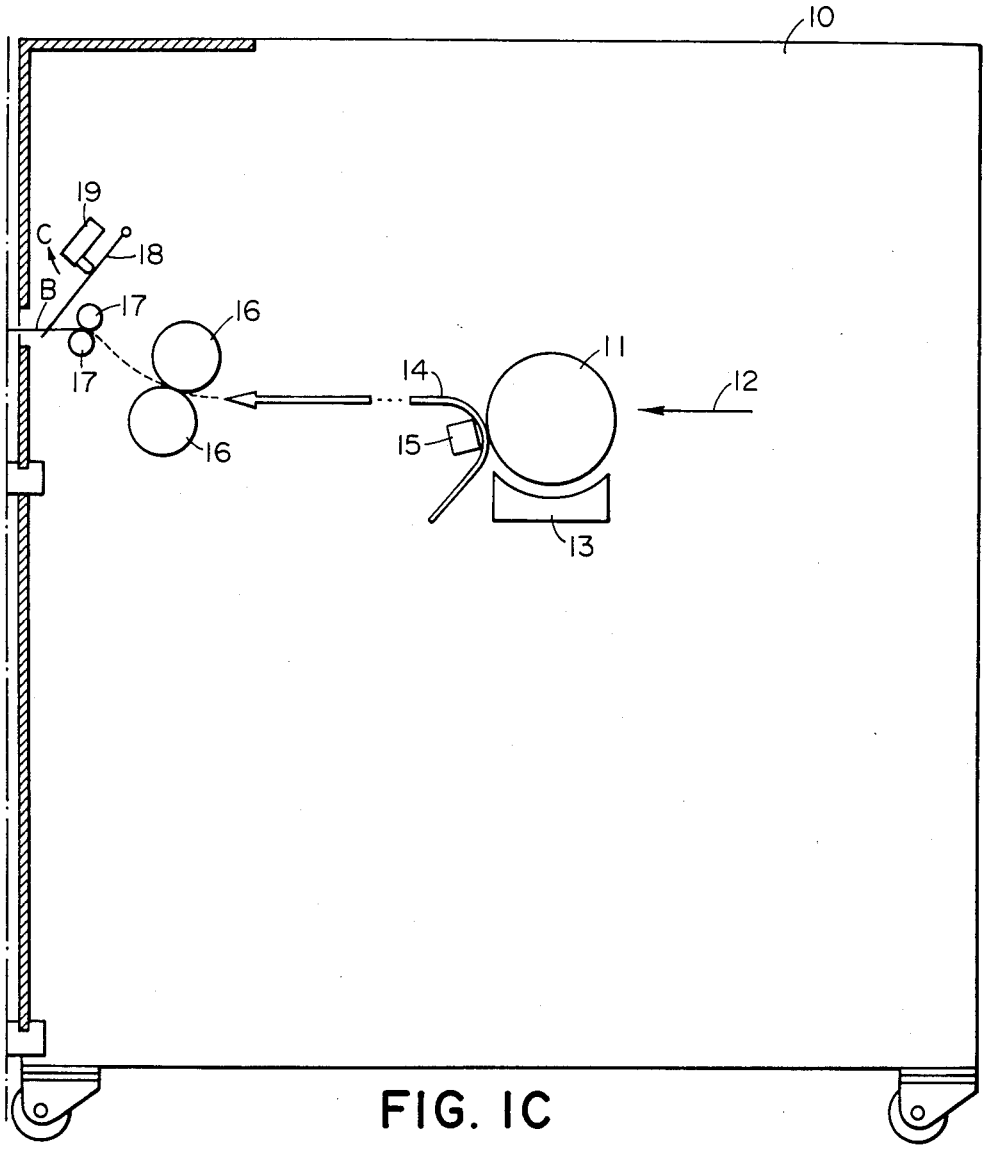
Figure 1A:
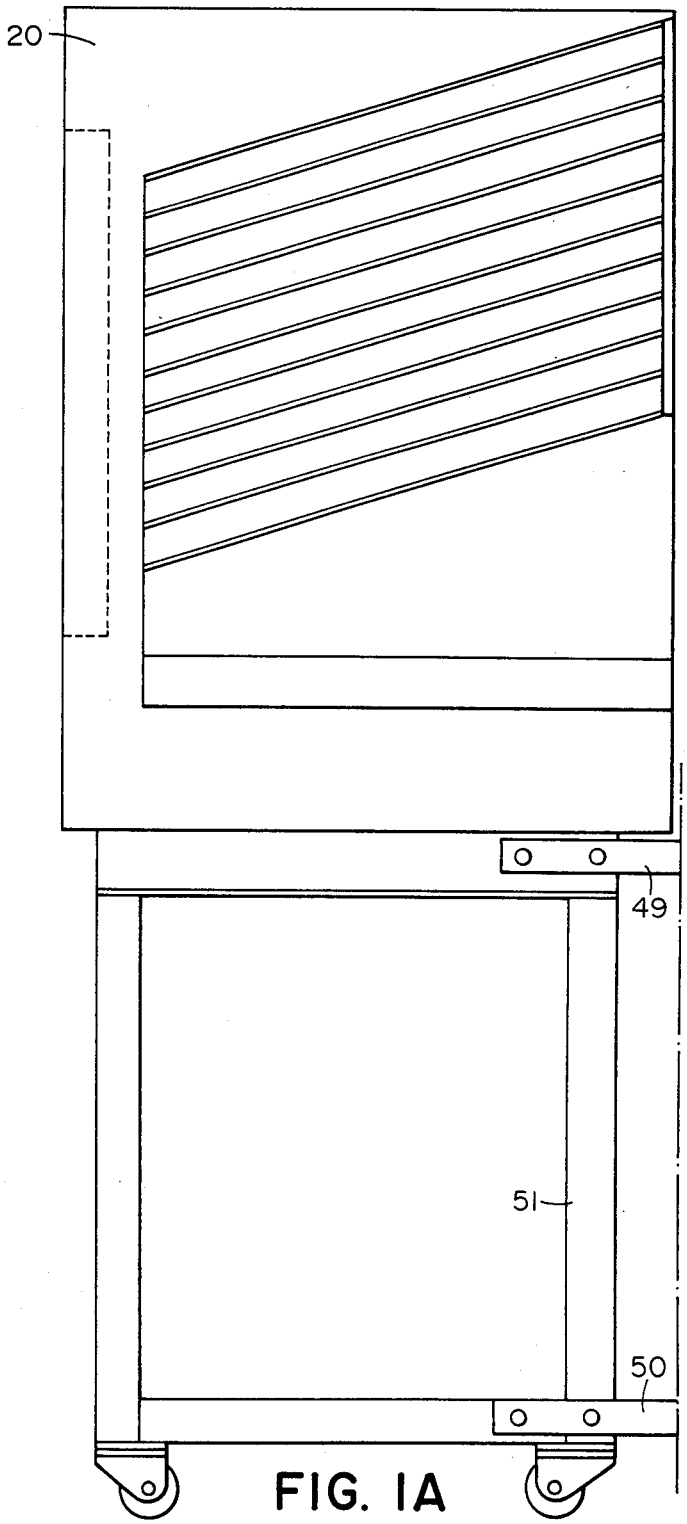
Figure 1B:
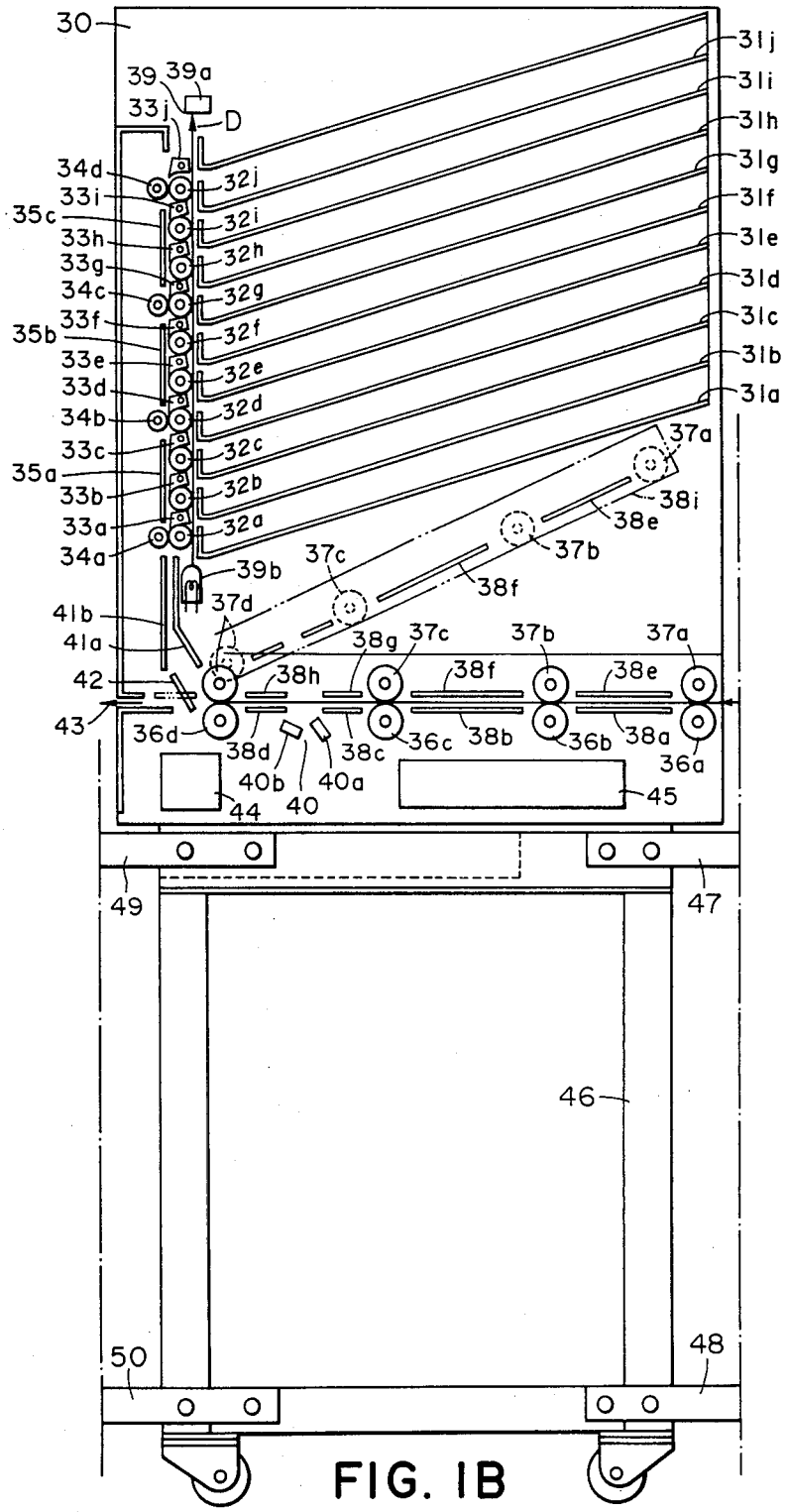

In FIG. 1 there is shown a laser beam recording apparatus 10 in which a photosensitive drum 11 subjected to primary charging is exposed to a modulated laser beam 12 to form a latent image. Said latent image is rendered visible in a developing station 13, and the visible image thus obtained is transferred in a transferring station 15 onto a transfer sheet 14, and is fixed thereon during passage between fixing rollers 16. The sheet after image fixation is ejected from the printer 10 by means of an eject rollers 17 at a speed V1 same as the transport speed of said sheet 14 in the laser beam printer 10.

An arm 18 is displaced in a direction C by the sheet 14 ejected by the ejecting rollers 17, thereby actuating a switch 19 to detect the passing of the sheet 14.

The aforementioned ejecting rollers 17 are provided with a one-directional clutch enabling to extract the sheet 14 with a speed larger than the ejecting speed V1 of said ejecting rollers.

Sorters 20, 30 for sorting the sheets 14 ejected from the laser beam printer 10 are provided with storage bins 31*a*–31*j* for storing said sheets 14; vertical transport rollers 32*a*–32*j* for transporting said sheets 14 in the vertical direction and positioned respectively corresponding to the entrances of said storage bins 31*a*–31*j*; bin selecting claws 33*a*–33*j* positioned respectively corresponding to said bins 31*a*–31*j* and being rotated by selecting solenoids to be explained later, thereby guiding sheets 14 to corresponding bins; auxiliary rollers 34*a*–34*d* positioned to be in pressure contact respectively with the aforementioned vertical transport rollers 32*a*, 32*d*, 32*g* and 32*j*; and auxiliary guide plates 35*a*, 35*b*, 35*c* positioned between said auxiliary rollers 34*a*–34*d*.

A sensor 39 for detecting the arrival of the sheet 14 at the bin entrance is composed of a photoreceptor 39*a* and a lamp 39*b*, wherein the light therefrom proceeds along a path indicated by the arrow D between the bin entrances and transport rollers 32*a*–32*j* and is received by the photoreceptor 39*a*.

A horizontal transport unit is composed of horizontal transport rollers 36*a*–36*d* for transporting the sheets 14 from the laser beam printer 10 toward the bins 31, and pressure rollers 37*a*–37*d* maintained in pressure contact with said rollers 36*a*–36*d*.

Said horizontal transport unit is further provided with guide plates 38*a*–38*h* between which said sheets 14 are guided. Said horizontal transport unit is divided into a lower unit and an upper unit, of which the latter can be rotated to a chain-lined position about an unrepresented axis for enabling removal of a jammed sheet and inspection of the horizontal transport unit.

A sheet detector 40 composed of a light source 40*a* and a photoreceptor 40*b* is provided to detect the arrival at a determined position of the sheet 14 transported in the horizontal transport unit.

There are further shown guide plates 41*a*, 41*b* of the vertical transport unit, and a selecting claw 42 for controlling the sheet transport either to the second sorter 20 or to the vertical transport unit of the first sorter 30. Said claw is normally in the full-lined position to guide the sheets from the horizontal transport unit to the aforementioned vertical transport unit, but is rotated to a double-dotted chain-line position by an unrepresented solenoid in which the sheets are forwarded from the horizontal transport unit to the second sorter 20 through an outlet 43.

Said second sorter 20 is of the same structure as the first sorter 30 and is therefore not explained in detail.

A drive motor 44 drives the vertical transport rollers 32*a*–32*j* and horizontal transport rollers 36*a*–36*d* through unrepresented belts.

There are also shown a power supply circuit 45, a pedestal 46 provided with castors, connecting members 47, 48 for connecting said pedestal with said laser beam printer 10, and connecting members 49, 50 for connecting the pedestal 45 of the first sorter 30 with the pedestal 51 of the second sorter 20.

Figure 2:
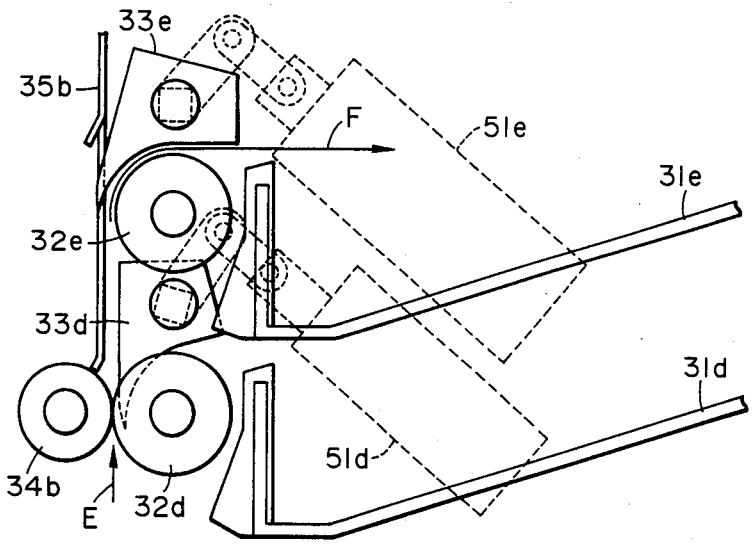
FIG. 2 is a partial magnified view of the sorter shown in FIG. 1.

FIG. 2 is a magnified view of a part of the vertical transport unit shown in FIG. 1, wherein solenoids 51*d*, 51*e* are provided for rotating the bin selecting claws 33*d*, 33*e*. The sheet transported along an arrow E is guided by the claw 33*e* rotated by the solenoid 51*e* and is further forwarded by the vertical transport roller 32*e* for storage in the bin 31*e*.

Figure 3:
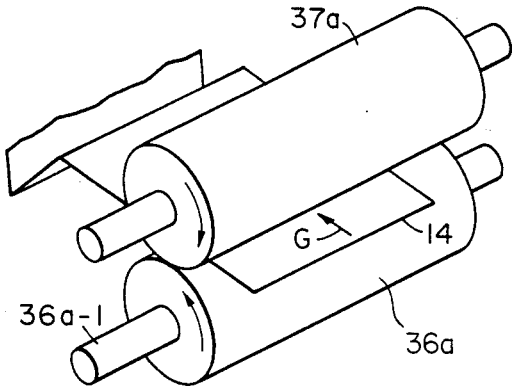
FIG. 3 is a partial perspective view of said sorter.

FIG. 3 is a partial magnified view of the horizontal transport unit showing jammed state of the sheet 14. The horizontal transport roller 36*a* is made of an elastic material such as rubber and is connected, by means of the elastic frictional force thereof, to a roller drive shaft 36*a*-1. Thus, in response to the rotation of the said drive shaft 36*a*-1 by the motor 44, the horizontal transport roller 36*a* is rotated by said frictional force to advance the sheet 14 in the direction G with a transport speed V2 which is larger than the sheet transport speed V1 in the laser beam printer 10. Since the aforementioned elastic frictional force of the horizontal transport roller 36*a* is so selected as to only transmit the driving force enough for the normal sheet feeding, the horizontal transport roller 36*a* slips on the drive shaft 36*a*-1 to terminate the sheet advancement when the sheet 14 is jammed at the leading end thereof to apply a load larger than the aforementioned frictional force. In this manner the sheet 14 is not jammed severely and can be removed easily afterwards.

Such frictional drive utilizing the elasticity of the roller is employed also on other horizontal transport rollers 36*b*, 36*c* and 36*d*.

Figure 4:
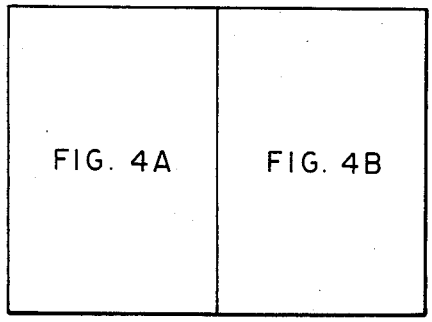
FIG. 4 is a depiction of the relationship of the circuitry illustrated in FIGS. 4A and 4B.

Now there will be given an explanation on the control system. FIG. 4 is a block diagram of the control system incorporated in the sorter, and FIG. 5 is a timing chart for the sheet transport and bin control. In the following explanation will principally given on the function of the sorter 30.

As shown in FIG. 5*a*, the sheets 14 are transported through the fixing rollers 16 of the laser beam printer 10 with a speed V1 and with a mutual interval G1.

When the sheets 14 are ejected by a certain length from the ejecting rollers 17, they are pinched at the leading ends by the rollers 36*a*, 37*a* and transported at the larger speed V2, and the ejecting rollers 17 are provided with one-directional clutches for this purposes. Consequently the switch 19 provides the output signals as shown in FIG. 5*b*, and the sheets 14 have an interval G3.

Said sheets 14 are then transported by the rollers 36, 37 through the detector 40 at the speed V2, whereby said detector 40 provides output signals as shown in FIG. 5*c* and the sheets 14 maintain the wider interval G3.

After passing the detector 40, the sheets 14 are vertically transported by the vertical transport rollers 32*a*–*j*, 34*a*–*d* and stored in the selected bins. FIG. 5*d* shows the output signals of the sensor 39 in case the sheets are stored in succession in the first bin 31*a*, 10th bin 31*j*, first bin 31*a*, . . .

Figure 4A:
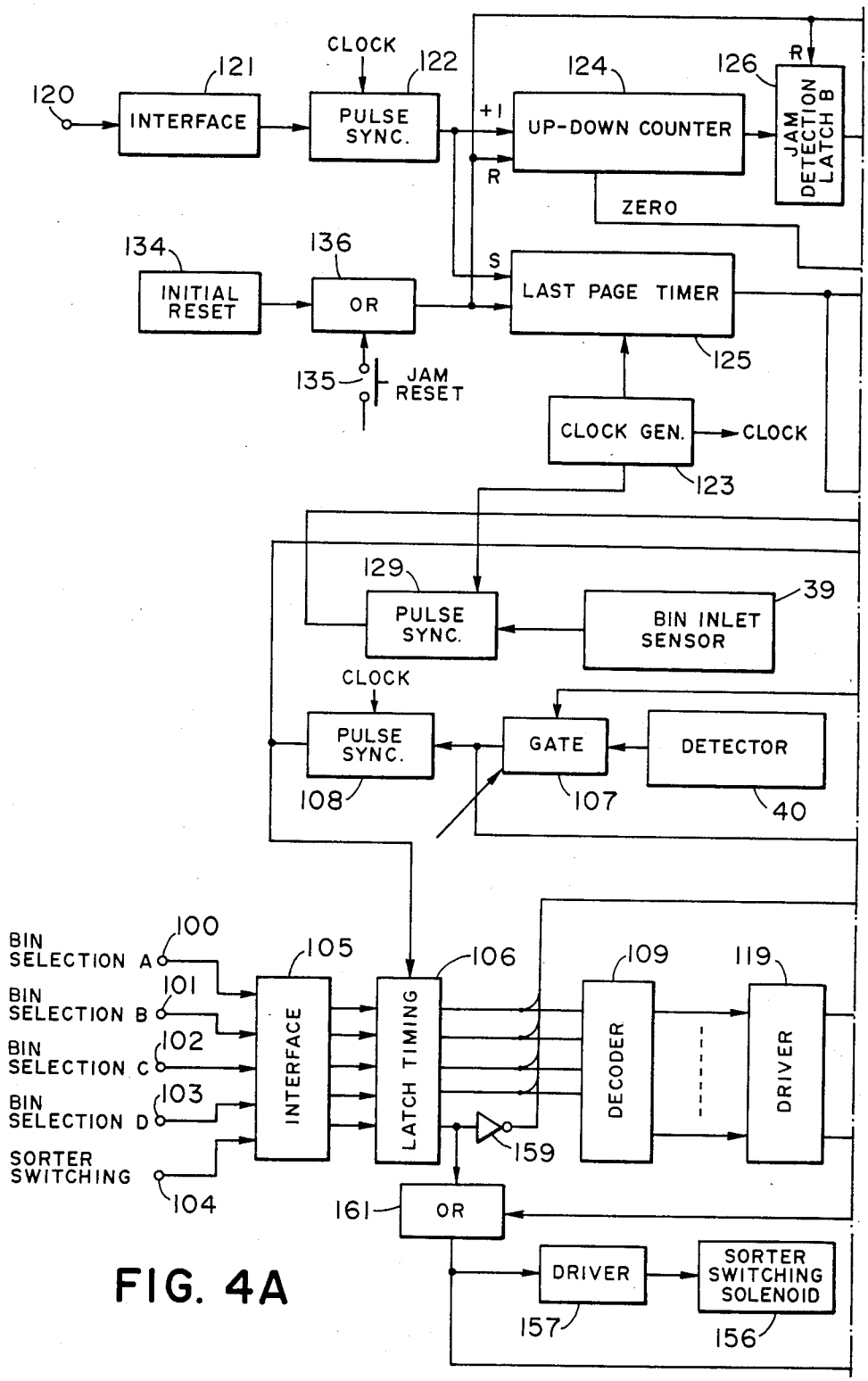
FIGS. 4A and 4B shows, in their combination, a diagram of the control circuit for said sorter.
Figure 4B:
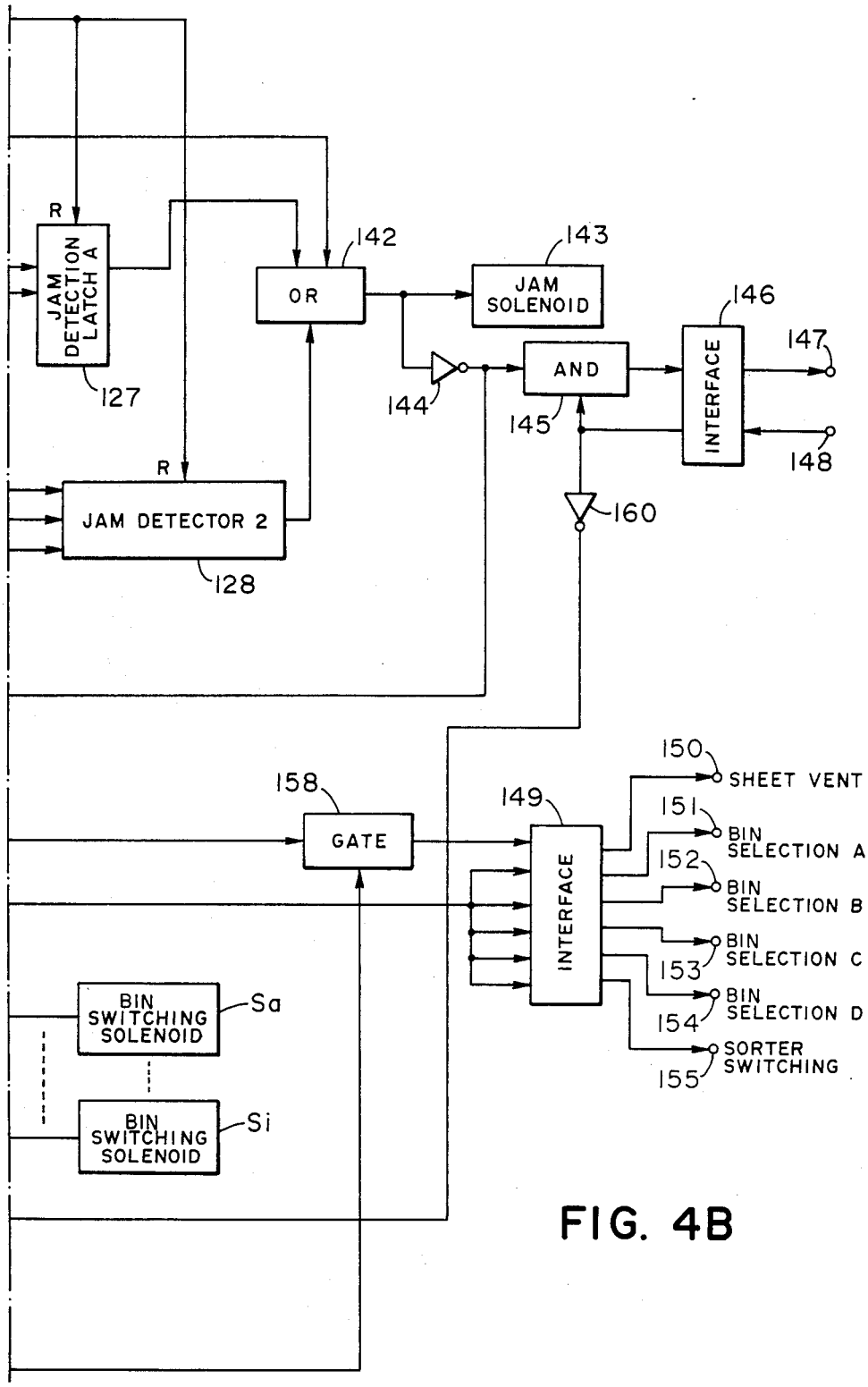

Now the bin selecting procedure is explained with reference to FIGS. 4A, 4B, and 5. After a determined time from the sheet ejection, the laser beam printer 10 supplies bin selection signals A - D (FIG. 5*h*, *i*, *j*, *k*) to terminals 100–103 of the sorter 30. Also a sorter switching signal is supplied to a terminal 104 if it is necessary to select the second sorter instead of the first sorter.

The bin selection signals A - D and the sorter switching signal are supplied through an interface circuit 105 and latched by a 5-bit latch circuit 106, of which latch pulse is released at the leading end of the output signal from the detector 40 and is obtained by passing said output signal through a gate 107 and synchronizing said signal with a clock pulse in a pulse synchronizer 108. Said gate 107 is provided to interrupt the output signal from the detector 40 in case the sorter 30 shows sheet jamming or a door switch thereof is cut off.

The bin selection signals and the sorter switching signal latched in said latch circuit 106 are decoded in a decoder 109 to drive bin selecting solenoids Sa - 5*i* through a driver 119, which is composed of nine transistorized swtiching circuits. The uppermost 10th bin 31*j* farthest from the sorter entrance is not provided with a solenoid, since this bin can be selected by not energizing any other solenoid. For this reason the claw at the inlet of said 10th bin is constantly in the rotated position.

FIG. 5*p* shows the drive signal for the first bin positioned closest to the sorter entrance. The detector 40 is so positioned that a sheet arrives at said detector only after the preceding sheet has been stored in a bin since otherwise a premature bin selection may cause the bin selecting claw to engage with the preceding sheet. Such situation can be represented by:

$$t_1 > (x_1 + x_2)/S$$

wherein $t_1$ is the interval of sheet ejection from the laser beam printer 10 as shown in FIG. 5, $x_1$ is the length from the detector 40 to the inlet of the 10th bin, $x_2$ is the length of sheet, and S is the transport speed in the sorter, which is equal to the transport speed $V_2$. However, since $t_1$ is given by the performance of the laser beam printer 10 and $x_2$ is also given by length of the sheet, the abovementioned relation has to be satisfied by suitably selecting $x_1$ and S. Said relation can be satisfied by decreasing $x_1$ or increasing S, but the value of $x_1$ cannot be made smaller than distance from the 1st bin to the 10th bin, and the detector 40 has to be placed in front of the sorter switching claw as long as the signal therefrom is to be used for selecting the timing for sorter switching. On the other hand the value of S is limited by the motor noise, service life of belts and bearings. Thus the values of $x_1$ and S are determind in consideration of these factors. Also if the left-hand term in the foregoing relation is equal to the right-hand term, there may result erroneous functions due to positional aberration of the detector 40 or slippage in the transport of the sheets.

Now there will be explained the procedure of jam detection.

The jam detection is conducted in two sections, i.e. that between the laser beam printer 10 and the detector 40 of the sorter 30, and that from said detector 40 to the sheet storage in the bins. As already explained, the latter jam detection is conducted when the succeeding sheet reaches the detector 40. This method is however imcomplete because the jamming of the last sheet cannot be detected as there is no following sheet. In the present embodiment, therefore, there is provided a timer to be actuated only at the last page, and the jam detection for the last page is conducted by a signal from said timer.

On the other hand the former jam detection is achieved by the transport time from the laser beam printer 10 to the bin entrance sensor, or the detector 40 in the present embodiment, and the sheet jamming is identified if the sheet 14 does not reach said detector within a determined time.

This jam detection method is satisfactory in case the sheet ejection switch of the laser beam printer 10 is positioned close to the bin entrance sensor, but is uneconomical in requiring two times if the distance to the sensor is relatively long while the sheet ejecting interval is short as in the present embodiment, whereby it becomes necessary to measure the transport time for sheet before the time measurement for the preceding sheet is completed. Also the time measurement requires a complicated control because of the conversion of the sheet speed and also because the transport time between the sensors is variable according to the sheet size. In the present embodiment, therefore, based on a fact that only two sheets at maximum can be simultaneously present between the sensors, a sheet jamming is identified in case three or more sheets are simutaneously present between said sensors. As this method is however still ineffective for the jamming of the last sheet, there is employed a timer activated by the last sheet for confirming the absence of sheets between said sensors.

The above-mentioned jam detection method by the presence of three or more sheets between the paper ejection sensor of the printer 10 and the detector 40 of the sorter, as employed in the present embodiment, has a disadvantage of requiring a longer time for jam detection in case of larger sheets, and the jammed sheets may be crammed between the guide plates or finely torn up, thus rendering the removal quite tedious.

For this reason the transport roller is so structured as to cause slippage on the roller shaft as already explained in the foregoing when an abnormally high transport power is required because of sheet jamming, thus avoiding the damage to the sheet and facilitating the jam handling.

Figure 6:
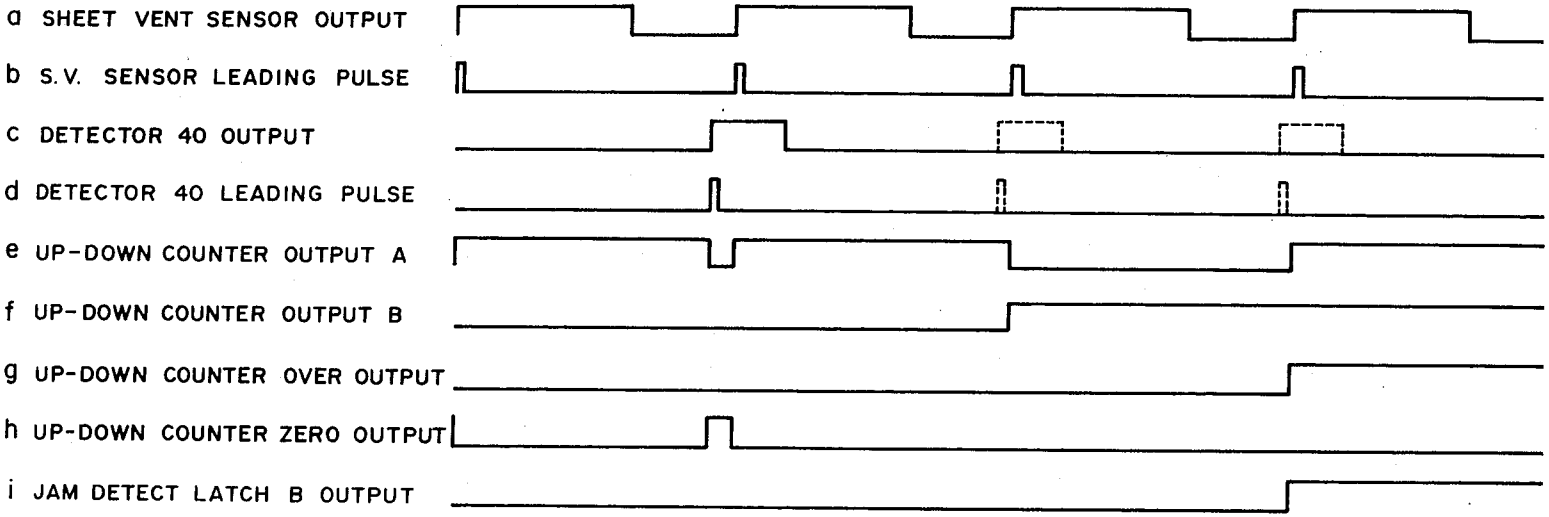

Now there will be explained the jam detection procedure, at first for the path from the switch 19 constituting the sheet ejection sensor for the laser beam printer 10 to the detector 40, while making reference to FIGS. 4A, 4B, and 6. A sheet ejection sensor signal (FIG. 6*a*) from the printer 10 is supplied through an input terminal 120 and an interface circuit 121 and is synchronized in a pulse synchronizer 122 with a clock pulse from a clock pulse generator 123 to obtain a pulse signal corresponding to the leading end of said sheet ejection sensor signal as shown in FIG. 6*b*. Said pulse signal is supplied to an up-down counter 124 to step advance the same, and activate a last page timer 125. Said last page timer 125 is reset and reactivated by each sheet ejection leading-end pulse, so that it is continuously activated as long as the sheets are ejected in succession and releases a time-over signal only when there is no ensuing sheet.

Said up-down counter 124 is step reduced by a timing sensor leading-end pulse (FIG. 6*d*) released from the pulse synchronizer 108 when the sheet reaches the timing detector 40.

FIG. 6 shows a state in which the second sheet is jammed between the paper ejection switch 19 and the detector 40. In this state the detector 40 does not provide the output signal for the second sheet and thereafter, whereby up-down counter 124 is no longer step reduced to provide level-1 signal to the lower digit output A (FIG. 6*e*) and to the upper digit output B (FIG. 6F). In this state said counter 124 releases a countover output signal (FIG. 6*g*) which is latched by a jam detection latch circuit B 126 (FIG. 6*i*).

Figure 7:
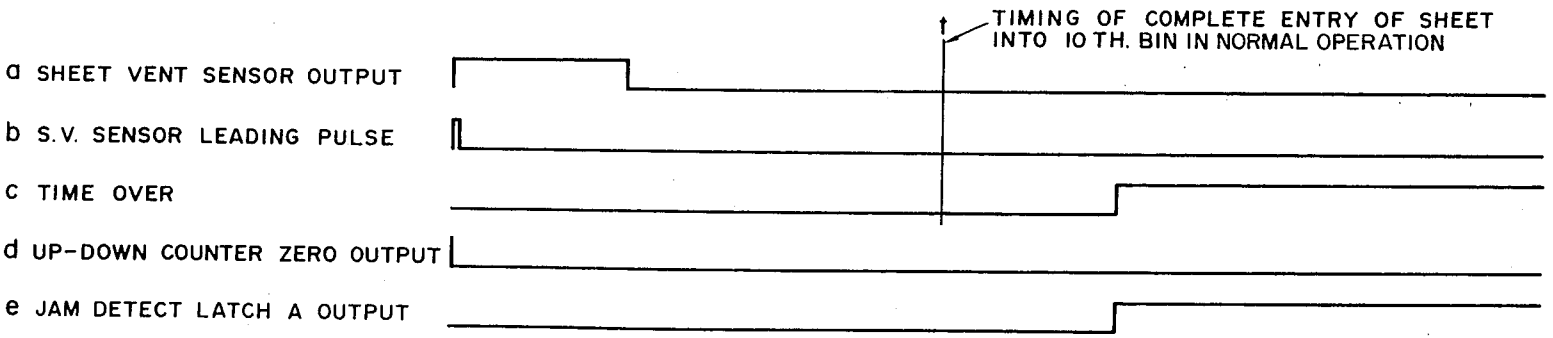

Also FIG. 7 shows a state in which the first sheet, which is also the last sheet, is jammed between the sheet ejection switch 19 and the detector 40.

FIGS. 7*a* and 7*b* respectively show the output signal of the sheet ejection switch and pulse signals corresponding to the leading ends of said output signals. Upon receipt of said pulse signal the up-down counter 124 is step advanced to shift the zero output thereof (FIG. 7*d*) to the low level. Thereafter said up-down counter 124 remains in the same state, and the zero output thereof is latched by a jam detection latch circuit A 127 when the time-over output signal (FIG. 7*c*) of the last page timer 125 is shifted to the high level.

Figure 8:
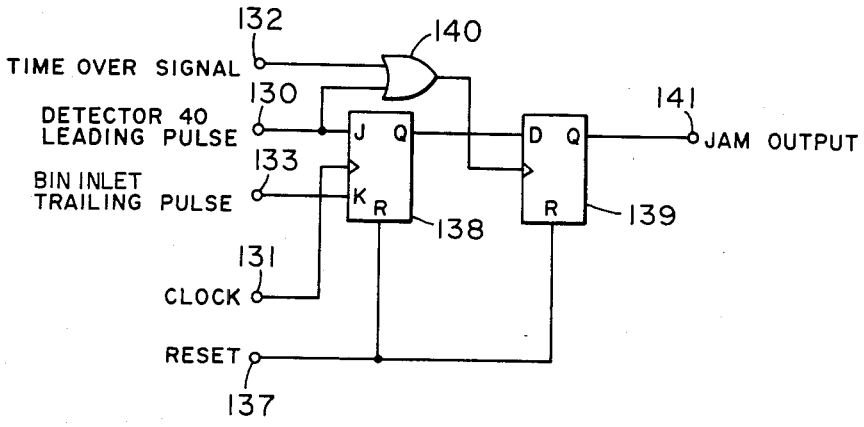
FIG. 8 is a diagram of a jam detection circuit.
Figure 9:
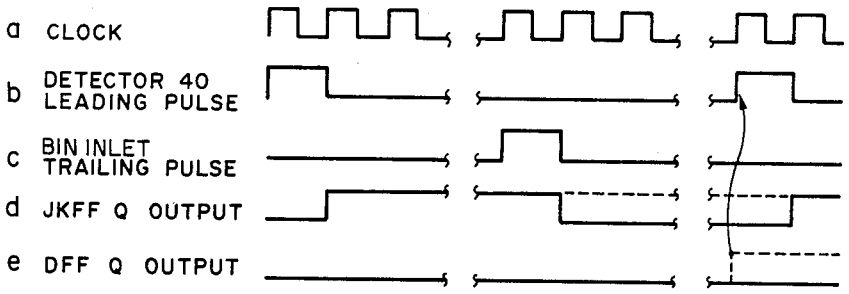
FIG. 9 is a waveform chart showing various signals in said circuit.

Now there will be explained the jam detection procedure in the path from the detector 40 to the bins. Said jam detection is achieved by a jam detection circuit 128 shown in FIG. 8, of which waveform chart is shown in FIG. 9.

Terminals 130, 131 and 132 respectively receive the timing sensor leading-end pulse (FIG. 9*b*) from the pulse synchronizer 108, the clock pulse (FIG. 9*a*) from the clock generator 123, and the time-over signal from the last page timer 125. Also the output signal of the bin inlet sensor 39 is synchronized in the pulse synchronizer 129 with the clock pulse to obtain a pulse signal corresponding to the trailing end of said output signal, and said pulse signal (FIG. 5*g*, FIG. 9*c*) is supplied to a terminal 133.

An initial reset signal obtained from an initial reset signal generating circuit 134 at the turning on of the power supply and a signal obtained from jam reset switch 135 in case of sheet jamming are supplied to an OR circuit 136, which thus supplies a reset signal to a terminal 137. A JK flip-flop 138 for detecting the storage of the preceding sheet in the bin provides a high-level Q-output in response to the output signal from the detector 40, and a low-level Q-output at the trailing end of the output signal from the bin inlet sensor 39, i.e. when the sheet has completely passed said sensor. In case of sheet jamming in the intermediate path, the JK flip-flop 138 maintains the high-level Q-output because of the absence the trailing-end pulse from the bin inlet sensor 39, as shown by broken lines in FIG. 9*d*. A D-flip-flop 139 is provided to latch the output of said JK flip-flop 138 at the leading end of the output signal from the detector 40. In case of absence of the succeeding sheet, the time-over signal, instead of said leading-end signal, is supplied through the terminal 132 and an OR circuit 140 to the clock input port of the D-flip-flop 139 thereby latching the output of the JK flip-flop 138. Said flip-flops 138, 139 are reset by the reset signal from the terminal 137 at the turning on of the power supply and when the sheet jamming is resolved. The output signal from said flip-flop 139 is supplied to a terminal 141 as a jam output signal.

Again referring to FIGS. 4A and 4B, the jam detection output signals from jam detection latch circuits 126, 127 and jam detection circuit 128 are supplied through an OR circuit 142 to drive a jam solenoid 143 for lifting the upper unit of the horizontal transport unit thereby accumulating the sheets in said unit. Said signals, after inversion in an inverter 144, are urilized to close a gate 107 and, after addition in an AND circuit 145 with another jam signal supplied from other sorters through a terminal 148 and an interface circuit 146, supplied to the laser beam printer 10 through an interface circuit 146 and a terminal 147 to terminate the function of said printer.

Now there will be explained the control in case two sorters are connected in series.

In such use most difficult is the transmission of the bin selection signals. In case of conventional successive bin selection, the first bin of the second sorter can be selected when all the bins in the first sorter have been selected. In the random bin selection, however, it becomes necessary to transmit the bin selection signals in synchronization with the sheet transport. In the present embodiment the aforementioned detector 40 is utilized for achieving the synchronized transmission of the bin selection signals. More specifically, upon arrival of a sheet at the detector 40 of the first sorter, the latch circuit 106 of the first sorter latches the bin selection signal and transmits the same to the second sorter. In the second sorter having a control circuit indentical with that shown in FIGS. 4A and 4B, a latch circuit 106 thereof latches the bin selection signal and selects the bins upon arrival of the sheet at the detector 40 of said second sorter. Also in case of the use of three or more sorters, the transmission of bin selection signals synchronized with the sheet transport can be achieved in a similar manner by means of the signal latching by the detectors 40.

Figure 10:
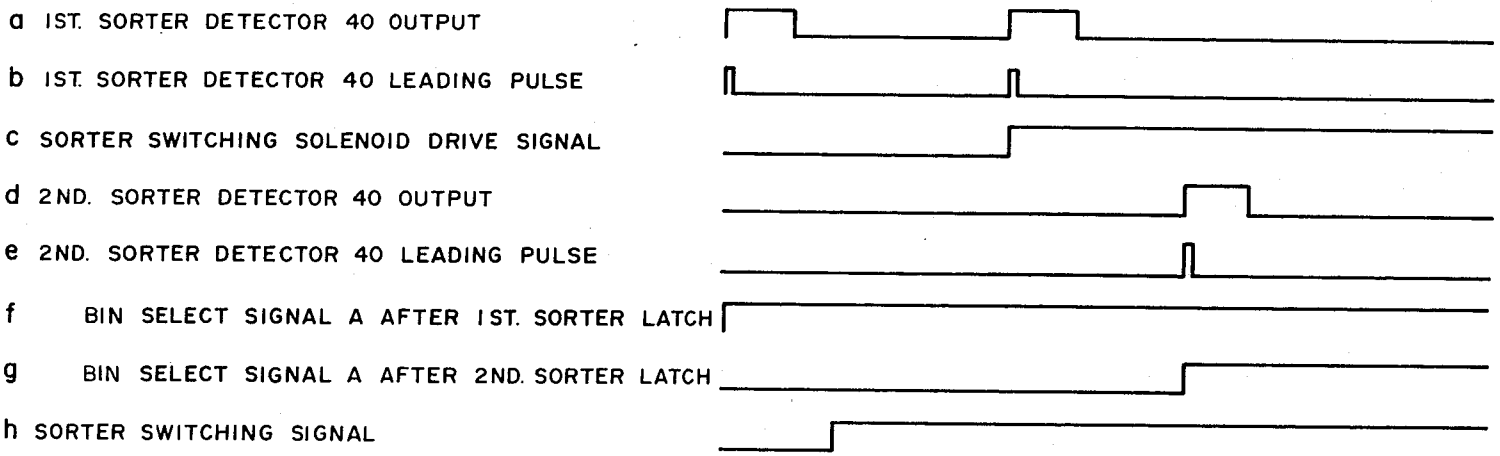
FIG. 10 is a waveform chart showing various signals in case two sorters are employed as shown in FIG. 1.

FIG. 10 is a timing chart for the bin selection signal transmission in case the first sheet is addressed to the first bin of the first sorter and the second sheet is addressed to the first bin of the second sorter. For the purpose of simplicity the signal A alone is represented.

Upon arrival of a sheet, the detector 40 of the first sorter releases output signals shown in FIG. 10*a* of which leading ends provide pulse signals as shown in FIG. 10*b*, which are utilized for latching the bin selection signal in the latch circuit 106 as shown in FIG. 10*f*. The sorter switching signal (FIG. 10*h*) is simultaneously latched to drive a sorter switching solenoid 156 (FIG. 10*c*) through a sorter switching driver circuit 157, whereby the sorter switching claw 42 is displaced to cause the sheet to be ejected from the first sorter.

The sheet ejected from the first sorter enters the second sorter and passes the detector 40 (timing sensor) thereof as shown in FIG. 10*d*. At the leading end of the output signal therefrom, the pulse synchronizer of the second sorter provides pulse signals shown in FIG. 10*e*, which are utilized for latching the bin selection signal for the second sorter as shown in FIG. 10*g*. The bin selection signal thus latched immediately activates the bin selection solenoid to select a bin.

In this manner the bin selection signal is transmitted from the first sorter to the second sorter in synchronization with the transport of the sheet. Since the latching takes place at the timing of bin selection, it is not necessary to temporarily memorize the bin selection signal and to transfer said signal to another latch circuit at the bin selection. Also the above-explained process allows simple transmission and storage of the bin selection signal since no timing pulse is needed except the leading-end pulse of the output signal from the timing sensor.

The jam detection in the second sorter is conducted in the similar manner as in the first sorter, utilizing the output signal from the timing sensor of the first sorter instead of the output signal from the sheet ejection sensor of the printer. The timing signal from the first sorter is transmitted to the second sorter through a gate 158, in order to prevent erroneous function of the jam detection circuit of the second sorter, which is caused if the sheet ejection signal from the timing sensor of the first sorter is supplied to the second sorter while it is not being used. The passing through said gate 158 is supplied through an interface circuit 149 and a terminal 150.

The sorter switching signal from the first sorter is supplied to the second sorter through an inverter 159, an interface circuit 149 and a terminal 155. Because of said signal inversion, the signal level "0" indicates the selection of the signal-receiving sorter, and the signal level "1" indicates the selection of another sorter. Thus, in case the signal "1" is latched in the first sorter, the sorter switching solenoid is activated, as the first sorter identifies that it is not selected. The signal inversion is inserted between the first and second sorters since said latched signal, if transmitted without inversion, causes the second sorter to also identify that it is not selected. In this manner it is rendered possible to employ identical circuits in the first and second sorters. The bin selection signals A–D and the sorter switching signal are released from the first sorter through terminals 151–155.

Now there will be explained the control in case of sheet jamming in the second sorter, while making reference to FIGS. 4A, 4B, and 11 to 13.

Figure 11:
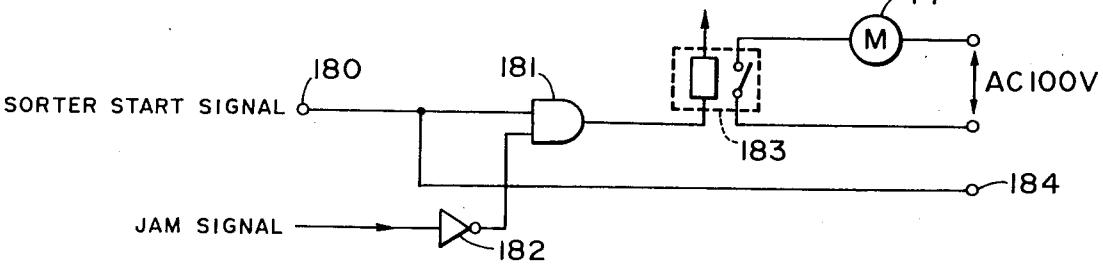
FIG. 11 is a diagram of a drive motor control circuit for the sheet transport unit of the sorter.

FIG. 11 shows a control circuit for the sheet drive motor in the sorter, wherein a sorter start signal is supplied to an input port of an AND circuit 181 from a terminal 180. The other input port of said AND circuit 181 receives a jam signal from the OR circuit 142 (FIG. 4) through an inverter 182. Consequently, in the absence of sheet jamming and in the present of the sorter start signal, the AND circuit 181 continues to release a "1" signal thereby energizing a relay 183 for driving the motor 44. If the sorter start signal is terminated or if the jam signal is supplied, the AND circuit 181 releases a "0" signal to terminate the function of the motor 44. The sorter start signal supplied from said terminal 180 is transmitted to the next sorter through a terminal 184.

Figure 12:
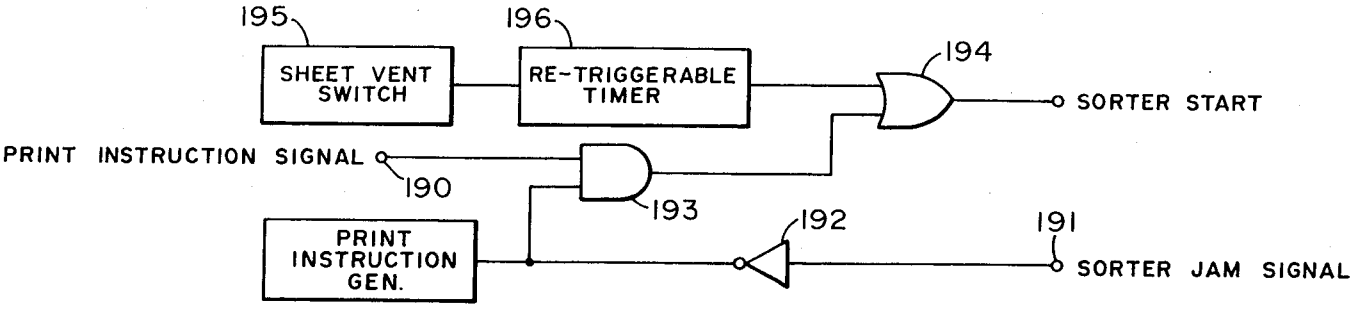
FIG. 12 is a diagram of a sorter control circuit in the printer.

FIG. 12 shows a sorter control circuit in the laser beam printer 10, wherein a print instruction signal is supplied from a terminal 190 to an input port of an AND circuit 193. The other input port thereof receives a sorter jam signal from the sorters through a terminal 191 and an inverter 192. Consequently in the absence of sheet jamming in the sorters and in response to the print instruction signal, the AND circuit 193 releases a "1" signal to provide the sorter start signal through an OR circuit 194.

Said print instruction signal is continued during the printing operation and is terminated after the completion thereof. However the output signal of the sheet ejection switch 195 activates a retriggerable timer 196 to continue the sorter start signal for a period $t_a$ after the completion of sheet ejection, thereby ensuring the sorting of the last sheet into an appropriate bin. Said period $t_a$ corresponds to the time from the sheet ejection from the printer 10 to the sheet storage in the farthest bin in the farthest sorter in the normal function of the sorters.

The sorter jam signal entered from the terminal 191 is also transmitted to a print instruction signal generator to terminate the print instruction signal in case of sheet jamming.

Figure 13:
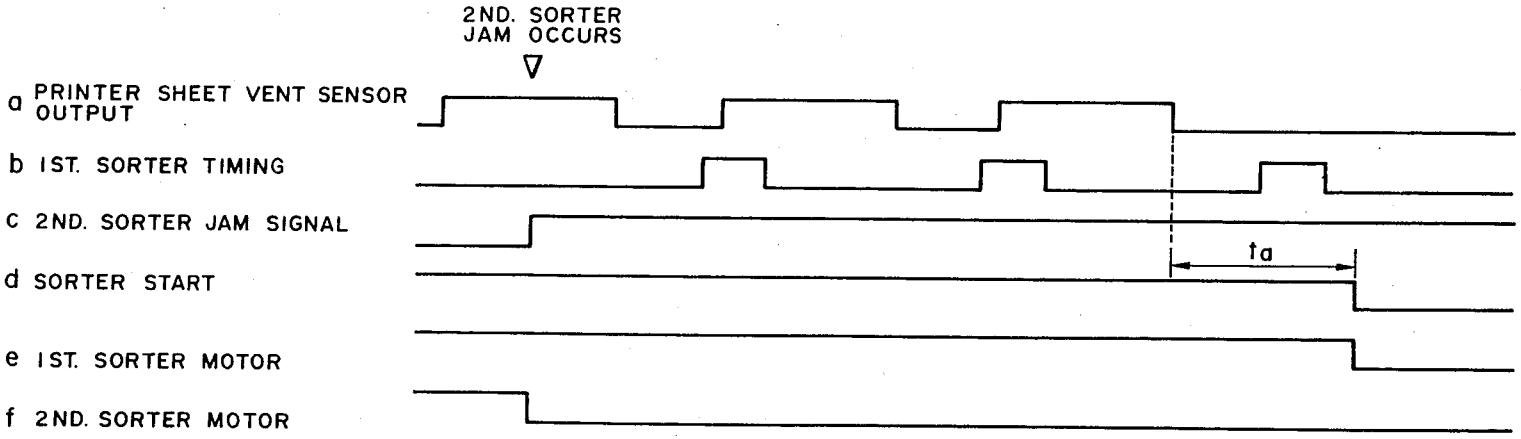
FIG. 13 is a waveform chart of various signals in case of sheet jamming in the second sorter.

FIG. 13 shows various signals in the sorter in case of sheet jamming in the second sorter. In response to a jam signal (FIG. 13*c*) in the second sorter, the laser beam printer 10 terminates the function thereof as explained in the foregoing by the signal from the terminal 147 (FIG. 4B) and ejects all the sheets printed up to this point (FIG. 13*a*). Also in the second sorter, in response to the jam signal, the AND circuit 181 releases a "0" signal to deactivate the relay 183, thereby stopping the motor 44 (FIG. 13*f*). At the same time the jam solenoid is energized to lift the upper unit of the horizontal transport unit. Also the jam signal from the second sorter is supplied to the terminal 148 of the first sorter, then inverted in an inverter 160 and transmitted to an OR circuit 161 thereby forcedly driving the sorter solenoid 156 through the driver 157, thus switching the sorter. The sorter start signal is maintained (FIG. 13*d*) for the aforementioned period $t_a$ by means of the retriggerable timer 196 after the ejection of the last sheet, and the motor 44 of the first sorter is maintained in operation during said period (FIG. 13*f*). In this manner all the sheets supplied from the printer to the sorters after the sheet jamming are collected in the horizontal transport unit of the second sorter.

Although the foregoing embodiment has been achieved with logic circuits, it is naturally possible to achieve the same objective with a micro-processor.

As explained in the foregoing, the present invention, capable of increasing the intervals of the sheets in the sorters, allows simple control avoiding parallel processing of the bin selecting control or jam detection.

Also the present invention, allowing bin selection in synchronization with the sheet transport, permits dispensing with memories for maintaining the bin addresses even in case of random bin access.

Furthermore the present invention allows easy removal of unnecessary sheets in case of sheet jamming since the jammed sorter is immediately stopped and all the sheets transported upstream of said jammed sorter are collected in the horizontal transport unit of said sorter.

In addition to the foregoing, the present invention ensures correct order of pages when the printing operation is restarted after the sheet jamming.

What we claim is:

1. A sorter comprising:

a transport path for transporting sheet members;

transport means for transporting sheet members with a predetermined carrier time interval $t_1$, said sheet members being delivered at a first speed $v_1$, and transported along said transport path at a second speed $v_2$ higher than said first speed;

plural storage bins arranged along said transport path for storing sheet members transported by said transport means;

driving means for driving said transport means at the second speed; and selection means for selecting a one of said plural storage bins which correspond to a storage destination of a sheet member, and at a point when the sheet member reaches a predetermined position upstream of the most upstream one of said plural storage bins, the following relationship is satisfied:

$$t_1 > (x_1 + x_2) / v_2$$

where:

$x_1$ is the distance between said predetermined position and the most downstream one of said plural storage bins, and $x_2$ is the length of the sheet member.

2. A sorter according to the claim 1, wherein said transport means is maintained in function for a determined period after the last sheet member to be sorted is supplied to said transport path.

3. A sorter according to claim 1 further comprising detecting means for detecting the sheet member in said determined position, wherein a selection control of the storage bin is carried out in accordance with the detection output of said detecting means.

4. A sorter according to claim 3 further comprising deflecting means for storing the sheet member in one of said plural storage bins, wherein said deflecting means is activated in response to said detection means to store the sheet member in a predetermined bin.

5. A sorter comprising:

a first housing section for accommodating sheet members;

a second housing section coupled with said first housing section for accommodating sheet members transported through said first housing section, wherein said first and second housing sections include:

a transport path for the sheet members transport means for transporting the sheet members along said transport path;

plural storage bins arranged along said transport path for storing the sheet member transported by said transport means;

detecting means for detecting defective transfer of the sheet members in said transport path in said second housing section; and control means for controlling the function of said transport means in response to the output from said detecting means, said control means controlling said transport means such that, in case of detection of defective sheet transport in said second housing section, the sheet members transported to said first housing section are collected in a determined position in said second housing section after passing through said first housing section regardless of the transport destination of the sheet members.

6. A sorter according to the claim 5 wherein said transport path comprises a horizontal transport unit dividable into an upper portion and a lower portion.

7. A sorter according to claim 6, which is adapted to terminate the function of said transport means and to open the upper portion of said horizontal transport unit in response to the detection of defective transport by said detecting means.

8. A sorter according to the claim 5, which is adapted, in case of detection of defective transport, to continue to drive the transport means of the sorters other than the one showing said defective sheet transport.

* * * * *

UNITED STATES PATENT AND TRADEMARK OFFICE

CERTIFICATE OF CORRECTION

PATENT NO. : 4,676,499

DATED : June 30, 1987

INVENTOR(S) : JUNICHI KIMIZUKA, ET AL.

It is certified that error appears in the above-identified patent and that said Letters Patent is hereby corrected as shown below:

On the Title Page:

[63], Related U.S. Appl. Data, insert --Continuation of Ser. No. 290,671, Aug. 5, 1981, abandoned.--.

[57], Abstract, line 6, " said" should read --the--.

Column 1, line 32, "shorting sheets" should read --sorting of sheets;

line 34, softer" should read --sorter--.

Column 2, line 34, "viw" should read --view--.

Column 4, line 37, "principally given" should read --principally be given--;

line 47, "poses." should read --pose.--;

Column 5, line 36, "by length" should read --by the length--;

line 37, "abovementioned" should read --above-mentioned--.

Column 6, line 18, "simutaneously" should read --simultaneously--;

line 66, "6F)." should read --6f).--.

UNITED STATES PATENT AND TRADEMARK OFFICE

CERTIFICATE OF CORRECTION

PATENT NO. : 4,676,499

DATED : June 30, 1987

INVENTOR(S) : JUNICHI KIMIZUKA, ET AL.

It is certified that error appears in the above-identified patent and that said Letters Patent is hereby corrected as shown below:

Column 7, line 62, "urilized" should read --utilized--.

Column 11, line 21, "members transport" should read --members; transport--;

line 25, "member" should read --members--.

Signed and Sealed this

Ninth Day of February, 1988

*Attest:*

*Attesting Officer*

DONALD J. QUIGG

*Commissioner of Patents and Trademarks*